US011512548B2

(12) United States Patent
Schmidt et al.

(10) Patent No.: US 11,512,548 B2
(45) Date of Patent: Nov. 29, 2022

(54) DOWNHOLE CASING PULLING TOOL

(71) Applicant: Weatherford Technology Holdings, LLC, Houston, TX (US)

(72) Inventors: Ronald G. Schmidt, Tomball, TX (US); Michael Smalley, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 17/202,482

(22) Filed: Mar. 16, 2021

(65) Prior Publication Data

US 2021/0198968 A1 Jul. 1, 2021

Related U.S. Application Data

(62) Division of application No. 15/924,009, filed on Mar. 16, 2018, now Pat. No. 10,954,736.

(51) Int. Cl.
*E21B 31/20* (2006.01)
*E21B 23/01* (2006.01)

(52) U.S. Cl.
CPC ..... *E21B 31/20* (2013.01); *E21B 23/01* (2013.01)

(58) Field of Classification Search
CPC ..... E21B 31/20; E21B 23/01
See application file for complete search history.

(56) References Cited

U.S. PATENT DOCUMENTS 479,933 A * 8/1892 Carruthers ..... E21B 31/20 166/217
557,968 A * 4/1896 Carruthers ..... E21B 31/20 294/86.18
1,377,301 A * 5/1921 Youle ..... E21B 31/20 294/86.19

(Continued)

FOREIGN PATENT DOCUMENTS

EP 3592938 A1 1/2020
GB 2291086 A 1/1996
WO 03069115 A2 8/2003

OTHER PUBLICATIONS

United Kingdom Examination Report dated Jan. 4, 2022, for Application No. GB2013872.3.

(Continued)

*Primary Examiner* — Blake Michener
(74) *Attorney, Agent, or Firm* — Patterson + Sheridan, LLP

(57) ABSTRACT

A method and apparatus for removal of tools, tubulars, casing, or other components that become stuck in a well. An anchor includes a mandrel, a carrier disposed on the mandrel and movable relative to the mandrel between an extended position and a retracted position, and an insert configured to engage an internal surface of a tubular, the insert movably disposed in the carrier as the carrier moves between the extended position and the retracted position. A method for anchoring a tool in a wellbore includes deploying the tool into the wellbore through a tubular to a first position, the tool comprising an anchor having a carrier and an insert disposed in the carrier, extending the carrier towards the tubular, and moving the insert relative to the carrier while engaging the inserts with the tubular, thereby anchoring the tool in the wellbore.

9 Claims, 8 Drawing Sheets

(56) References Cited

U.S. PATENT DOCUMENTS

| | | | | | |
|---|---|---|---|---|---|
| 1,728,136 | A * | 9/1929 | Power | E21B 31/20 | 294/86.15 |
| 1,751,090 | A | 3/1930 | Lamoureux | | |
| 1,766,177 | A * | 6/1930 | Langstaff | E21B 31/20 | 166/55.7 |
| 1,874,688 | A * | 8/1932 | Zuckoralc | E21B 23/01 | 166/216 |
| 1,971,514 | A | 8/1934 | Stone | | |
| 4,823,919 | A | 4/1989 | Hayatdavoudi | | |
| 4,934,459 | A | 6/1990 | Baugh et al. | | |
| 4,941,532 | A | 7/1990 | Hurt et al. | | |
| 5,566,762 | A | 10/1996 | Braddick et al. | | |
| 5,636,690 | A * | 6/1997 | Garay | E21B 23/01 | 166/243 |
| 5,678,635 | A | 10/1997 | Dunlap et al. | | |
| 5,829,531 | A | 11/1998 | Hebert et al. | | |
| 6,119,774 | A * | 9/2000 | Doane | E21B 23/01 | 166/134 |
| 6,264,395 | B1 | 7/2001 | Allamon et al. | | |
| 6,681,858 | B2 * | 1/2004 | Streater | E21B 29/002 | 166/301 |
| 6,742,584 | B1 | 6/2004 | Appleton | | |
| 2003/0034159 | A1 | 2/2003 | Weinig et al. | | |
| 2010/0101779 | A1 | 4/2010 | Obrejanu | | |
| 2014/0224477 | A1 | 8/2014 | Wiese et al. | | |
| 2015/0292283 | A1 | 10/2015 | Lemm | | |
| 2016/0076327 | A1 | 3/2016 | Glaser et al. | | |
| 2020/0131886 | A1 * | 4/2020 | Hora | E21B 41/0035 | |

OTHER PUBLICATIONS

PCT Invitation to Pay Additional Fees, Partial International Search Report, and Provisional Opinion dated Jun. 19, 2019, for International Application No. PCT/US2019/021140.

PCT International Search Report and Written Opinion dated Aug. 12, 2019, for International Application No. PCT/US2019/021140.

United Kingdom Combined Search and Examination Report dated Apr. 11, 2022 for Application No. GB2204206.3.

* cited by examiner

DOWNHOLE CASING PULLING TOOL

CROSS-REFERENCE TO RELATED APPLICATIONS

This Application is a Division of application Ser. No. 15/924,009 filed on Mar. 16, 2018, which application is incorporated herein by reference in its entirety.

BACKGROUND

Field

Embodiments of the present disclosure generally relate to methods and apparatus for removal and retrieval of tools, tubulars, casing, or other components that become stuck in a well.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed, and a section of casing is lowered into the wellbore. An annulus is thus formed between the string of casing and the formation. The casing string is temporarily hung from the surface of the well. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with the drill string. The drill string is removed. A first string of casing is then run into the wellbore and set in the drilled-out portion of the wellbore, and cement is circulated into the annulus behind the casing string. Next, the well is drilled to a second designated depth, and a second string of casing or liner, is run into the drilled-out portion of the wellbore. If the second string is a liner string, the liner is set at a depth such that the upper portion of the second string of casing overlaps the lower portion of the first string of casing. The liner string may then be fixed, or "hung" off of the existing casing by the use of slips which utilize slip members and cones to frictionally affix the new string of liner in the wellbore. If the second string is a casing string, the casing string may be hung off of a wellhead. This process is typically repeated with additional casing/liner strings until the well has been drilled to total depth. In this manner, wells are typically formed with two or more strings of casing/liner of an ever-decreasing diameter.

Various types of fishing tools are used in wells to retrieve tools, tubulars, casing, or other components that become stuck in a well. In a typical technique, a drillpipe lowers a fishing tool into the well, and a grapple at the end of the tool engages the stuck component. An upward force on the drillpipe can then dislodge the component. In other techniques, jars that are hydraulically or mechanically powered can generate a jarring force to dislodge the stuck component.

For example, casing can become stuck in the well and may need to be retrieved. Traditional removal of the stuck casing is done either with pilot milling, pulling the casing free with jarring action, and then steady pulling applied through the drillpipe and the derrick's draw work. Milling is very time consuming and labor intensive. Additionally, using jars to deliver a retrieving force does not effectively retrieve mud stuck casing.

Although most stuck components, such as casing, can be dislodged using the above techniques and tools, some stuck components may require other means to be retrieved and may need techniques that avoid damaging the stuck component or other elements in the well. The subject matter of the present disclosure is directed to overcoming, or at least reducing the effects of, one or more of the problems set forth above.

SUMMARY

The present disclosure generally relates to methods and apparatus for removal of tools, tubulars, casing, or other components that become stuck in a well.

In one or more of the embodiments described herein, an anchor for use in a wellbore includes a mandrel, a carrier disposed on the mandrel and movable relative to the mandrel between an extended position and a retracted position, and an insert configured to engage an internal surface of a tubular, the insert movably disposed in the carrier as the carrier moves between the extended position and the retracted position.

In one or more of the embodiments described herein, a downhole casing pulling tool includes a mandrel extending through an anchor and a puller; the anchor including a carrier disposed on the mandrel and movable between an extended position and a retracted position and a plurality of inserts movably disposed in the carrier as the carrier moves between the extended position and the retracted position, the plurality of inserts configured to engage an internal surface of a tubular; and the puller including a puller piston disposed on the mandrel and movable between a first position and a second position.

In one or more of the embodiments described herein, a method for anchoring a tool in a wellbore includes deploying the tool into the wellbore through a tubular to a first position, the tool including an anchor having a carrier and an insert disposed in the carrier; extending the carrier towards the tubular; and moving the insert relative to the carrier while engaging the inserts with the tubular, thereby anchoring the tool in the wellbore.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, for the present disclosure may admit to other equally effective embodiments.

DETAILED DESCRIPTION

In the following description, numerous specific details are set forth to provide a more thorough understanding of the present disclosure. However, it will be apparent to one of skill in the art that the present disclosure may be practiced without one or more of these specific details. In other instances, well-known features have not been described in order to avoid obscuring the present disclosure.

Figure 1:
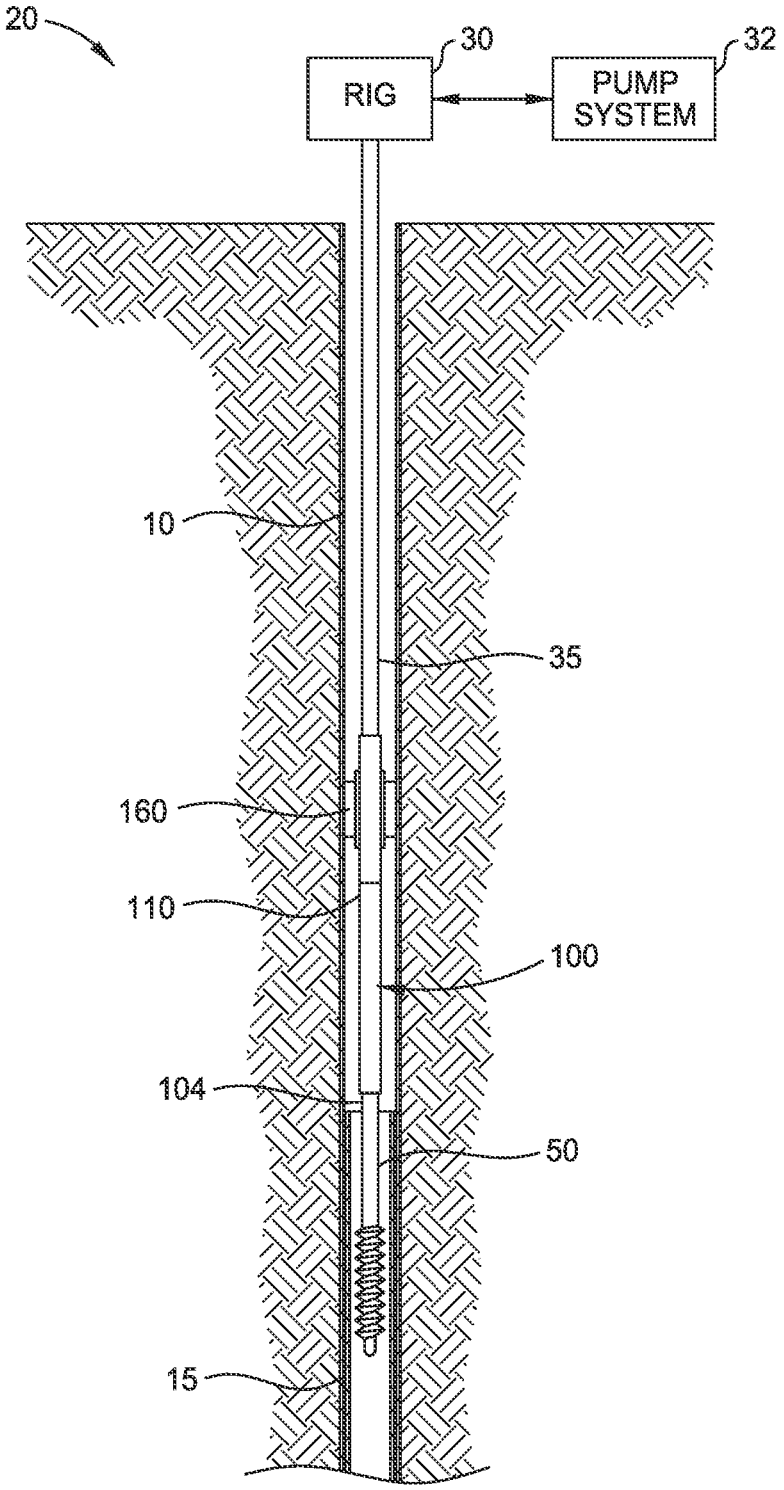
FIG. 1 illustrates a wellbore having a workstring deployed from a rig and having a pulling tool according to the present disclosure engaged with a stuck component.

When a well component 15 becomes stuck downhole, operators use a retrieval assembly 20, as shown in FIG. 1, to retrieve the well component 15. In general, the well component 15 can be casing, liner, pipe, tool, or the like that has become stuck downhole. Reference is made herein for convenience to stuck casing 15. Sections of stuck casing 15 to be pulled can be anywhere from 10 to 100 feet or more in length and may be stuck due to any number of reasons.

The retrieval assembly 20 has a pulling tool 100 according to the present disclosure. The pulling tool 100 may be used as a replacement for surface casing jack systems to retrieve stuck casing 15 or the like. In fact, the pulling tool 100 can be used to retrieve stuck casing 15 in applications where the drilling rig 30, platform, drillship, etc. or where the workstring 35 does not have sufficient capacity to pull the casing 15. Indeed, being able to remove casing 15 with the pulling tool 100 and without the need to perform milling operations can save rig time, reduce wear on rig equipment, and can eliminate swarf or metallic waste handling.

Operators deploy the pulling tool 100 on the workstring 35 into the wellbore from the rig 30, which has a pump system 32. The pulling tool 100 can be deployed to a first location in the wellbore above the stuck component 15. Various types of implements 50 and fishing tools can be used depending on the implementation and the operation to be performed. Accordingly, the pulling tool 100 can be used with various types of implements 50, such as standard casing cutting and fishing tools. When the implement 50 is engaged with the casing 15, the pulling tool 100 is used to exert the pulling force required to retrieve the casing 15.

The pulling tool 100 has an anchor 160 and a puller 110. The anchor 160 couples to the workstring 35 and the puller 110 extends further downhole from the anchor 160. At a distal end, the pulling tool 100 has the implement 50 supported on the puller 110 for engaging the well component 15.

In a pulling operation, for example, the pulling tool 100 is run on the workstring 35 downhole to a section of stuck casing 15 to be pulled uphole. The fishing tool 50 may be a spear, although any suitable type of tool, such as a basket grapple, spiral grapple, die collar, tapered taps, etc. can be used depending on the implementation.

Figure 2:
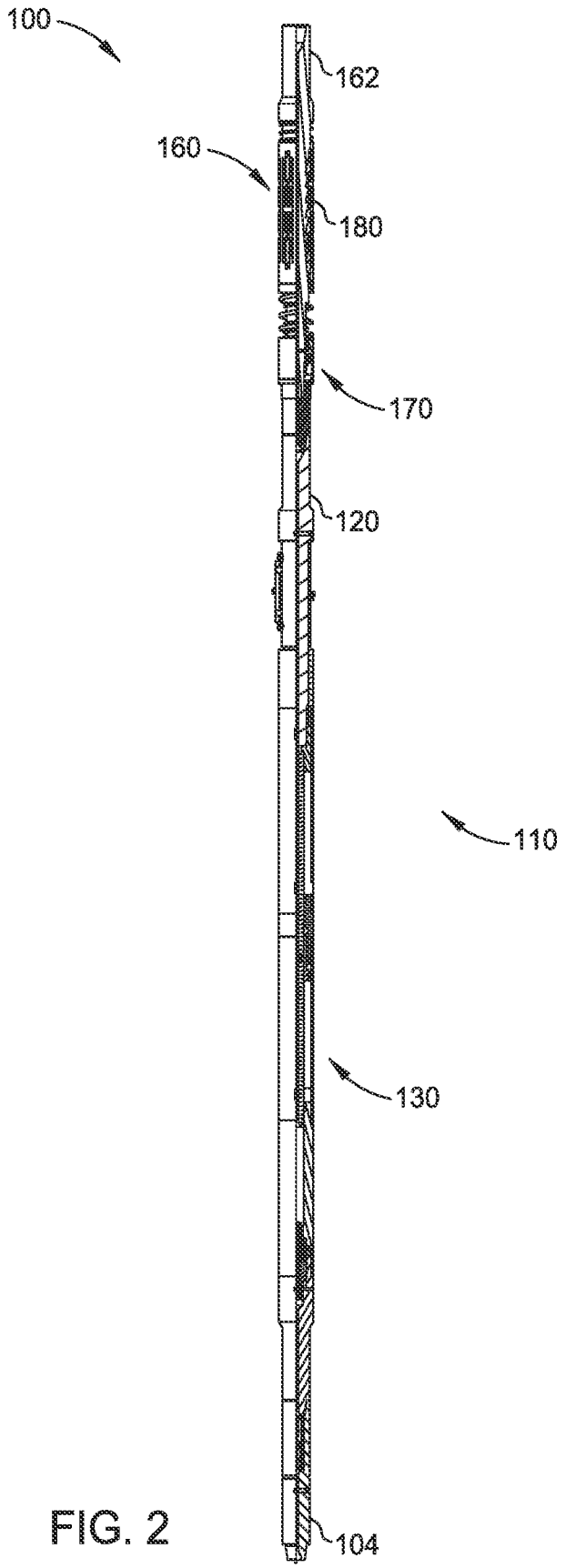
FIG. 2 illustrates a cross-sectional view of a pulling tool in an unstroked position, according to a first embodiment of the present disclosure.

The fishing tool 50 is then set to engage the stuck casing 15. With the fishing tool 50 set, the pulling tool 100 is in an unstroked position, as shown in FIG. 2. In the unstroked position, the puller 110 is stroked open with the piston(s) 130 extended on the puller's mandrel 120. The anchor's carrier 180 is also retracted on the anchor's mandrel 162 so the pulling tool 100 can be manipulated downhole by the workstring 35. Fluid flow down the workstring 35 can pass through the pulling tool 100. With the fishing tool 50 set as in FIG. 1, the anchor 160 on the pulling tool 100 is stroked as the anchor 160 holds the tool 100 in place in the outer casing 10. In particular, hydraulic pressure is applied down the workstring 35 via the pump system 32 to the puller 110, which is already stroked to the open position. Applying the hydraulic pressure may involve closing a valve, for example, by deploying a ball, plug, dart, or the like down the workstring 35 to close off fluid flow through a ball seat and apply the pressure to the tool's internal components.

The applied pressure sets the anchor 160 in the outer casing 10 and strokes the piston(s) 130 of the puller 110 to a closed position. In the stroked position, the puller 110 is stroked closed so that the end 104 where the implement or fishing tool 50 couples can be pulled uphole toward the anchor 160, which has the carrier 180 extended outward from the mandrel 162 to set the tool 100 in place downhole.

This stroked action of the tool 100 jacks (pulls) the stuck casing 15 of FIG. 1 uphole, as the pulling tool's stroke pulls the stuck casing 15 inside the outer casing 10. With the stroke complete, hydraulic pressure to the tool 100 from the workstring 35 is ceased, for example by stopping the pump system 32 or opening the valve in the tool 100 at the completion of the stroke to relieve the hydraulic pressure, and the anchor 160 on the pulling tool 100 is unset by a straight pull up on the tool 100 by the workstring 35. Continued pulling then releases the stroke of the pulling tool 100, resetting the puller 110 to the extending position for additional strokes. The pulling tool 100 can be moved to a second location within the outer casing 10 to pull the stuck casing 15 again. At this point, the pulling tool 100 can be reset to pull the stuck casing 15 again. If the stuck casing 15 has been sufficiently dislodged, then the assembly 20 can be retrieved along with the stuck casing 15 by tripping out the workstring 35. The anchor 160 is disposed uphole from the puller 110 which means the major pull loads are taken by the heavy body of the puller 110 and not by the smaller inner dimensions of the anchor's components. This gives operators the ability to exert larger pulling forces due to the larger cross-section of the pulling mandrel 162 resulting from this arrangement. Additionally, when manipulating the tool 100 and the workstring 35, all downhole torque is done through the larger OD members of the puller 110.

In some embodiments, the implement 50 can be a spear. The workstring 35 is rotated to set the spear 50 in the stuck casing 15, which can be a section of 9⅝ inch casing stuck in 13⅜ inch casing 10. When operated, the pulling tool 100 may be capable of generating a minimum 2 million lbs. downhole pulling force, can be about 50 feet long, can operate with maximum pressure of about 6,700 psi, and may have a 36 inch stroke length to pull the stuck casing 15. Other implementations and variables are possible as will be appreciated by one skilled in the art.

Figure 3A:
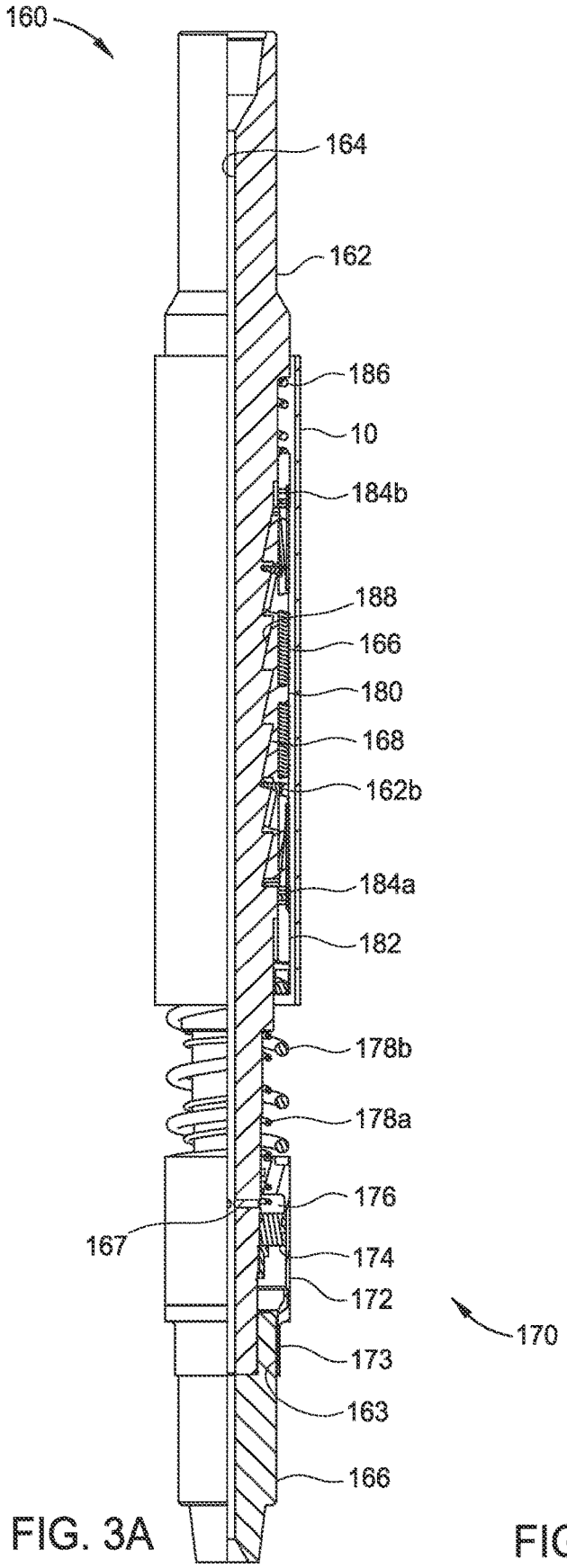
FIG. 3A illustrates a cross-sectional view of an anchor section of the pulling tool in an unset position, in accordance with the first embodiment of the present disclosure.

FIG. 3A illustrates a cross-sectional view of the anchor section 160 of the pulling tool 100, according to a first embodiment. The anchor 160 has an anchor mandrel 162 coupled to the workstring 35 at an uphole end in a conventional manner and forming a part of the overall mandrel of the pulling tool 100. The anchor mandrel 162 defines a fluid passageway or bore 164 communicating with the workstring 35 and conveying fluid to various components of the tool 100, as discussed below. The anchor mandrel 162 includes anchor ramps 168 formed on an outer surface thereof. Fasteners, such as bolts 162*b*, are at least partially disposed in the anchor mandrel 162. The bolts 162*b* are at least partially disposed in the anchor ramps 168. The bolts 162*b* project outward from an outer surface of the anchor ramps 168. The bolts 162*b* project outwards at an angle relative to the outer surface of the anchor ramps 168. In some embodiments, the bolts 162*b* project outwards at an angle substantially perpendicular to the outer surface of the anchor ramps 168. For example, the bolts 162*b* may project outwards at an angle less than or equal to ten degrees from perpendicular.

In the present embodiment, the anchor 160 has an anchor piston 170, at least one carrier 180, and a cage 182. In some embodiments, the anchor 160 includes a plurality of carriers 180. For example, the anchor 160 may include six carriers 180 disposed about an outer surface of the anchor mandrel 162. Each carrier 180 is disposed on an outer surface of the anchor mandrel 162. In some embodiments, the carriers 180 are spaced circumferentially about the anchor mandrel 162. The carriers 180 are hydraulically actuated from an unset or retracted position (FIGS. 3A-3B) to a set or extended position (FIGS. 4A-4B). In the set position, the carriers 180 wedge against a portion of the anchor mandrel 162 and specifically wedge against ramps 168 on the surface of the mandrel 162. In some embodiments, the carrier 180 may not engage the casing 10 in the set position.

In the present embodiment, the carrier 180 includes carrier ramps 188 formed on an inner surface thereof. The carrier ramps 188 correspond to and engage the anchor ramps 168. A slope of the carrier ramps 188 corresponds to a slope of the anchor ramps 168. For example, the slope of the carrier ramps 188 may be equal to the slope of the anchor ramps 168.

In the present embodiment, each carrier 180 is disposed in an opening in the cage 182. The number of openings in the cage 182 correspond to a number of carriers 180 of the tool 100. The cage 182 is a tubular mandrel having a bore therethrough. The cage 182 is disposed about the anchor mandrel 162. The cage 182 is movable relative to the anchor mandrel 162 between an unset position, shown in FIG. 3A, and a set position, shown in FIG. 4A. Each carrier 180 is retained in a respective opening in the cage 182. The cage 182 restricts lateral movement of each carrier 180. Spring retainers 184*a-b* are connected to the cage 182 at opposite ends by fasteners, such as screws. The cage 182 is biased towards the unset position by the spring retainers 184*a-b* and a return spring 186. In some embodiments, the carriers 180 form substantially a full circumference around the anchor 160. For example, the carriers 180 may form equal to or more than two thirds of a full circumference around the anchor. In some embodiments, the carriers 180 may be long rectangular bodies with a length of about 30 inches.

Figure 5A:
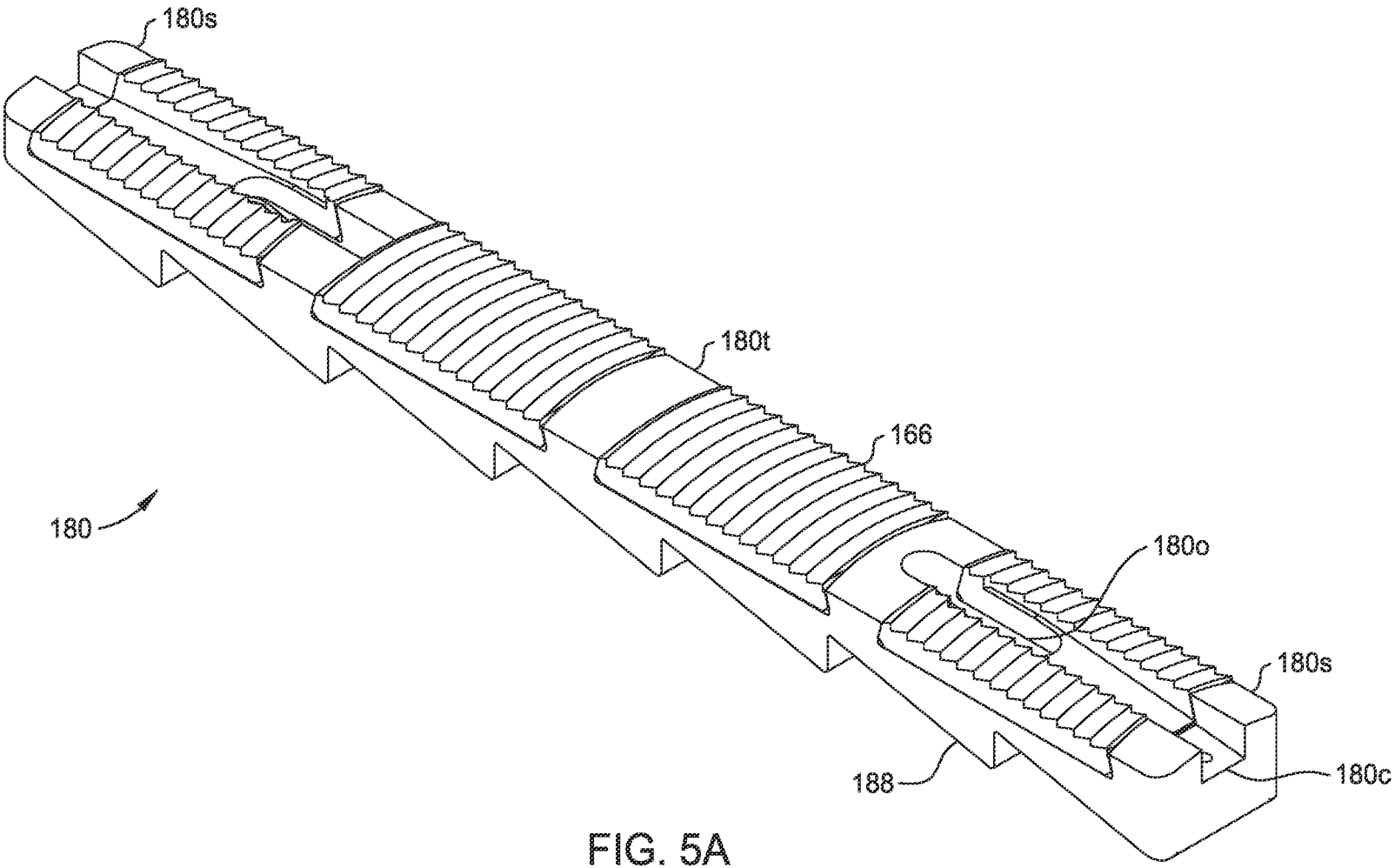
FIG. 5A illustrates an isometric view of the carrier of the anchor section having inserts disposed in pockets of the carrier according to the present disclosure.
Figure 5B:
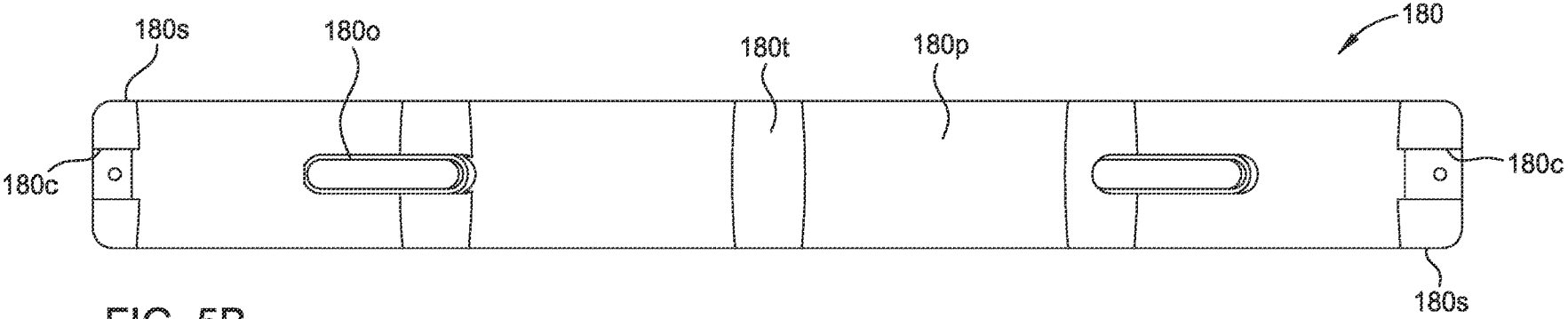
FIGS. 5B and 5C illustrates the carrier of the anchor section with the inserts removed.
Figure 5C:
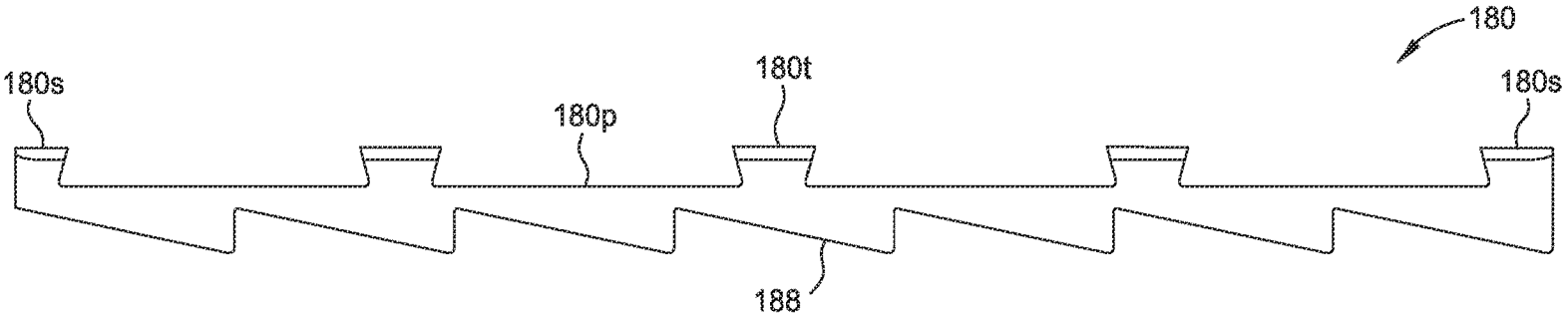

In the present embodiment as shown in FIGS. 5A-5C, the carrier 180 has an opening 180*o* formed therethrough. In some embodiments, the carrier 180 includes two openings 180*o* formed at opposite longitudinal ends thereof. The opening extends laterally through the carrier 180. The opening 180*o* extends through the carrier 180 at an angle relative to a longitudinal axis of the tool 100. The opening 180*o* extends through the carrier 180 at an angle corresponding to a slope of the carrier ramps 188. For example, the opening may extend laterally through the carrier 180 at an angle equal to a slope of the carrier ramps 188. An inner shoulder can be formed adjacent the opening. The inner shoulder can be formed at an angle relative to the longitudinal axis of the tool 100. The inner shoulder can be formed at an angle corresponding to a slope of the carrier ramps 188. The bolts 162*b* are at least partially disposed in the respective openings 180*o*. The bolts 162*b* engage the respective inner shoulder and movably couple the carrier 180 to the anchor mandrel 162. The bolts 162*b* restrain the carrier 180 from further lateral movement in the set position and retain the carrier 180 on the anchor mandrel 162.

The carrier 180 may include a pocket 180*p*. In some embodiments, the carrier 180 may include a plurality of pockets 180*p*. In some embodiments, the plurality of pockets 180*p* may be spaced longitudinally along the carrier 180. The pocket 180*p* may include a base and an opening. The base may extend along a longitudinal direction of the pocket 180*p*. The opening may extend along the longitudinal direction of the pocket 180*p*. A length of the base may be greater than a length of the opening. The carrier 180 may include a tab 180*t*. The tab 180*t* may be disposed between adjacent pockets 180*p*. Tabs 180*s* may be formed at opposite longitudinal ends of the carrier 180. Each of the pockets 180*p* may be a dovetail groove.

Figure 5D:
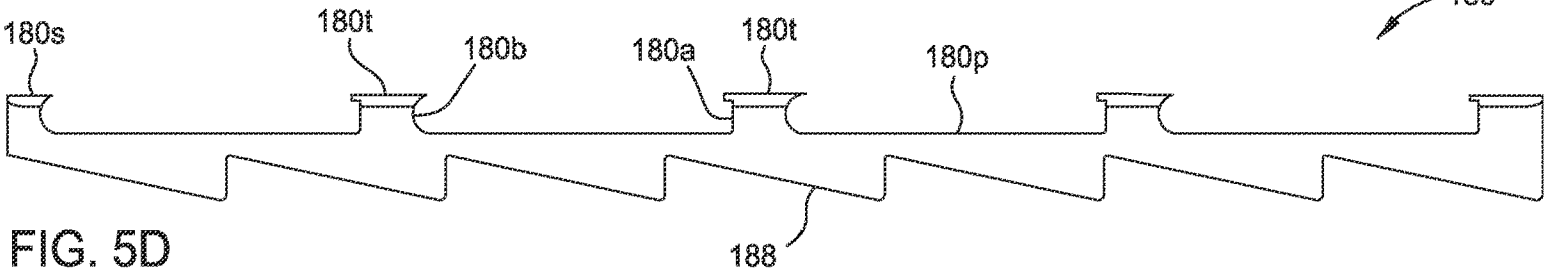
FIG. 5D illustrates the carrier of the anchor section, in accordance with an alternative embodiment.

FIG. 5D illustrates a carrier 180 according to an alternative embodiment. The pocket 180*p* includes a stepped side 180*a* and a curved side 180*b*. The pocket 180*p* may include two upper shoulders extending out from the respective adjacent tabs 180*t*, 180*s*. The upper shoulders may retain an insert 166 in the pocket 180*p*. In some embodiments, the pocket 180*p* includes two stepped sides 180*a*. In some embodiments, the pocket 180*p* includes two curved sides 180*b*. For example, a curved side of the pocket 180*p* may be an arc of a circle, such as a semicircle. In some embodiments, the carrier 180 includes multiple shapes for the pockets 180*p*, for example, a pocket with stepped sides and a dovetail groove pocket. In some embodiments, the pocket 180*p* may include multiple side shapes at opposite ends of the pocket 180*p*. For example, the pocket 180*p* may include a dovetail groove side and a stepped side, a dovetail groove side and a curved side, or a stepped side and a curved side.

Each of the pockets 180*p* may include angled sides on opposite longitudinal ends of the pocket 180*p*. The angled sides may form an angle with a bottom surface of the pocket 180*p*. In some embodiments, the angle between the bottom surface of the pocket 180*p* and the respective angled side may be substantially less than perpendicular. For example, the angle may be greater than or equal to ten degrees from perpendicular. In some embodiments, the angle between the bottom surface of the pocket 180*p* and the respective angled side may be between sixty and eighty degrees.

The pocket 180*p* may include a substantially flat bottom surface. In some embodiments, the pocket 180*p* includes a sloped bottom surface. For example, the pocket 180*p* includes a bottom surface forming an arc of a circle. The bottom surface of the pocket 180*p* may include a convex arc. In some embodiments, the pocket 180*p* includes a spherical bottom surface. For example, the pocket 180*p* includes a bottom surface forming a spherical cap or hemisphere. Slots 180*c* may be formed at opposite longitudinal ends of the carrier 180. The slots 180*c* may extend longitudinally through one or more pockets 180*p*. The slots 180*c* may extend through tabs 180*s*. The slots 180*c* may extend at least partially through tabs 180*t*. The slots 180*c* may terminate in the tabs 180*t*. The slots 180*c* may receive the spring retainers 184*a-b*.

Figure 6A:
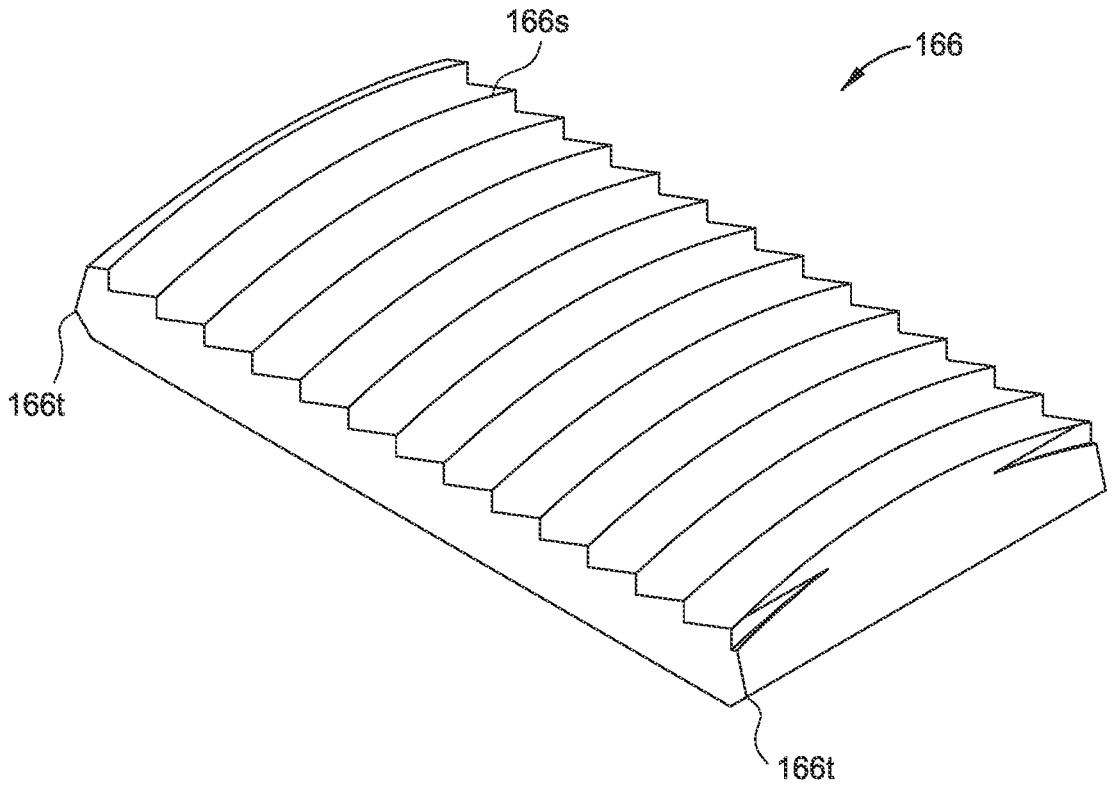
FIGS. 6A and 6B illustrate an insert of the anchor section, according to the present disclosure.
Figure 6B:
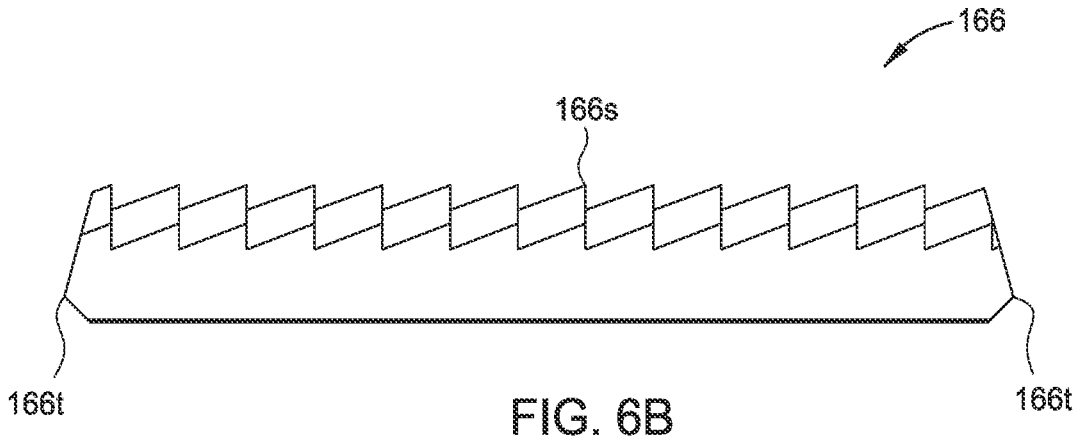

Each of the pockets 180*p* may receive at least one insert 166. A back of the insert 166 may engage the base of the pocket 180*p*. In some embodiments, each pocket 180*p* may receive a plurality of inserts 166. The plurality of inserts 166 may be arranged longitudinally in the carrier 180. The insert 166 may be configured to engage an internal surface of a tubular, such as the casing 10. As shown in FIGS. 6A and 6B, the insert 166 may include a gripping surface 166*s*. The gripping surface 166*s* may be configured to engage an internal surface of a tubular, such as the casing 10. The insert 166 may extend through the opening of the pocket 180*p*. For example, the gripping surface 166*s* extends through the opening of the pocket 180*p*. The insert 166 may extend through an opening of the cage 182. For example, the gripping surface 166*s* extends through the opening of the cage 182. The gripping surface 166*s* may include a plurality of gripping elements. The gripping elements may be wickers. The plurality of gripping elements may be arranged longitudinally and/or horizontally on the gripping surface 166*s*. For example, at least some of the plurality of gripping elements can be arranged horizontally on the gripping surface 166*s* for providing a torque connection to the engaged component. At least some of the plurality of gripping elements may be arranged longitudinally on the gripping surface 166*s* for providing an axial force to the engaged component. The gripping surface 166*s* engages the casing 10 in the set position, as shown in FIG. 4B.

Each insert 166 may be movably disposed in a respective pocket 180*p*. For example, the insert 166 is movably disposed in the carrier 180 as the carrier 180 moves between the extended position and the retracted position. In some embodiments, the insert 166 is movably disposed in the carrier 180 as the insert 166 engages an internal surface of a tubular, such as casing 10. In some embodiments, each insert 166 may include a single degree of freedom of movement in the respective pocket 180*p*. For example, the insert 166 is longitudinally movable in the respective pocket 180*p*. In some embodiments, each insert 166 may include two degrees of freedom of movement in the respective pocket 180*p*. For example, the insert 166 is longitudinally and laterally movable in the respective pocket 180*p*. The insert 166 may include two tapered end surfaces 166*t* corresponding to and configured to align with the dovetail groove of the respective pocket 180*p*. In some embodiments, the insert 166 includes end surfaces having complementary shapes to the sides of the respective pocket 180*p*. For example, the insert 166 may include a tapered end surface complementary to a dovetail groove side of the pocket 180*p*, a rectangular end surface complementary to a stepped side of the pocket 180*p*, and/or a curved end surface complementary to a curved side of the pocket 180*p*. In some embodiments, the insert 166 includes different end surface shapes corresponding and complementary to a pocket 180*p* including multiple side shapes at opposite ends of the pocket 180*p*. In some embodiments, the insert 166 includes a bottom surface complementary to a bottom surface of the pocket 180*p*. For example, the bottom surface of the insert 166 may include a concave arc complementary to a convex arc of the pocket 180*p*. In some embodiments, the bottom surface of the insert 166 includes a spherical cap shell or hemispherical shell bottom surface complementary to the hemispherical or spherical cap of the pocket 180*p*.

A clearance between the tapered end surfaces 166*t* of each insert 166 and the angled sides of the pockets 180*p* may allow the insert 166 to move longitudinally within the pocket 180*p*. In some embodiments, the clearance is a range between six hundredths of an inch and five thousandths of an inch. For example, the clearance being six hundredths of an inch, fifteen thousandths of an inch, ten thousandths of an inch, or five thousandths of an inch. Another clearance between the lateral end surfaces of each insert 166 and the cage 182 may allow the insert 166 to move laterally within the pocket 180*p*. In some embodiments, the clearance extends between an end surface of the insert 166 and a complementary bottom surface of the pocket 180*p*. For example, a clearance between an outer, lower edge of a spherical or hemispherical shell shaped insert 166 and a complementary hemispherical or spherical cap shaped bottom surface of the pocket 180*p* allows the insert 166 to move longitudinally and laterally over the complementary bottom surface.

In some instances, manufacturing tolerances, scale buildup, damage, and other common reasons may create irregularities on the internal diameter of a casing. Movement of the insert 166 within the pocket 180*p* may allow the gripping surface 166*s* to better follow contours on the internal diameter of the casing 10. Additionally, movement of the insert 166 within the pocket 180*p* may more evenly distribute the load applied by the inserts 166 against the casing 10. In some embodiments, inserts 166 disposed in pockets 180*p* adjacent either longitudinal end of the carrier 180 may include slots 166*a*. The slot 166*a* may extend longitudinally into the insert 166. The slot 166*a* may be configured to receive the spring retainers 184*a-b*.

The inserts 166 may be modular elements. In some embodiments, the gripping surface 166*s* of the insert 166 is flush with or extends outward past an outer surface of the cage 182 in the retracted position. In some embodiments, the gripping surface 166*s* of the insert 166 is flush with or extends outward past an outer surface of the carrier 180. In some embodiments, the gripping surface 166*s* of the insert 166 is retracted inward from an outer surface of the carrier 180 and/or the cage 182 in the retracted position. The cage 182 may laterally retain the insert 166 in the respective pocket 180*p*. The inserts 166 in the set position may engage downhole by setting in the outer casing 10, for example. In some embodiments, the inserts 166 form substantially a full circumference around the anchor 160. For example, adjacent inserts 166 may form equal to or more than two thirds of a full circumference around the anchor. In some embodiments, the inserts 166 may be rectangular bodies with a length of about 6 inches. Preferably, each insert 166 distributes the load of the pulling tool 100 along a length of the outer casing 100. In some embodiments, each carrier 180 includes three or more inserts 166. In some embodiments, the carriers 180 include differing numbers of inserts 166. In some embodiments, the carriers 180 include equal numbers of inserts 166.

The anchor piston 170 may be hydraulically movable from a first position (FIG. 3A) to a second position (FIG. 4A) on the mandrel 162 relative to the carrier 180 and cage 182. A detachable coupling having a collet 173 on the piston's body 172 may engage a shoulder, rim, or detent 163 on the mandrel 166 to hold the anchor piston 170 in place.

The operation of the pulling tool 100 according to the present embodiment is further discussed as follows. In the second position, fluid pressure communicated through the anchor bore 164 and cross-ports 167 enters a chamber 176 of the anchor piston 170. Pressure trapped in the chamber 176 by a seal block 174 pushes the anchor piston's body 172 toward the carrier 180, unlatching the collet 173 from the detent 163. Pushing against the carrier 180 via the cage 182, the anchor piston 170 extends the carrier 180 outward from the anchor mandrel 162 to engage the inserts 166 in the surrounding casing 10.

The carrier 180 in the unset position is retracted inward toward the anchor mandrel 162, whereas the carrier 180 in the set position is extended outward from the anchor mandrel 162. The anchor mandrel 162 defines at least one (and preferably multiple) ramped surfaces 168 against which complementary ramped surfaces 188 on the carrier 180 extend and retract when pushed thereagainst by the anchor piston 170.

Figure 3B:
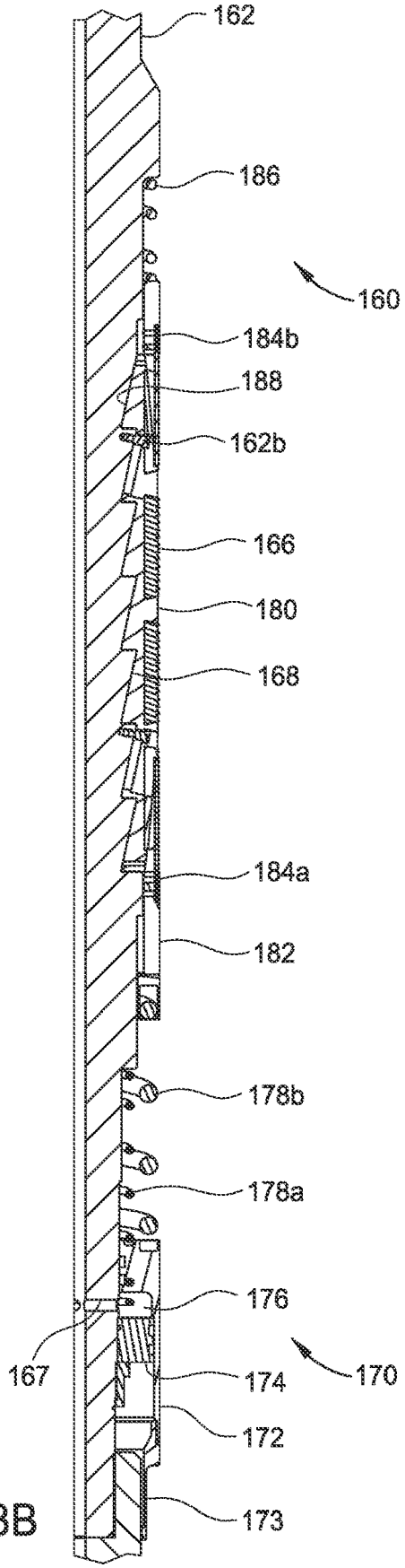
FIG. 3B illustrates a detailed cross-sectional view of the carrier and the anchor piston of the anchor section in the unset position, in accordance with the first embodiment of the present disclosure.
Figure 4A:
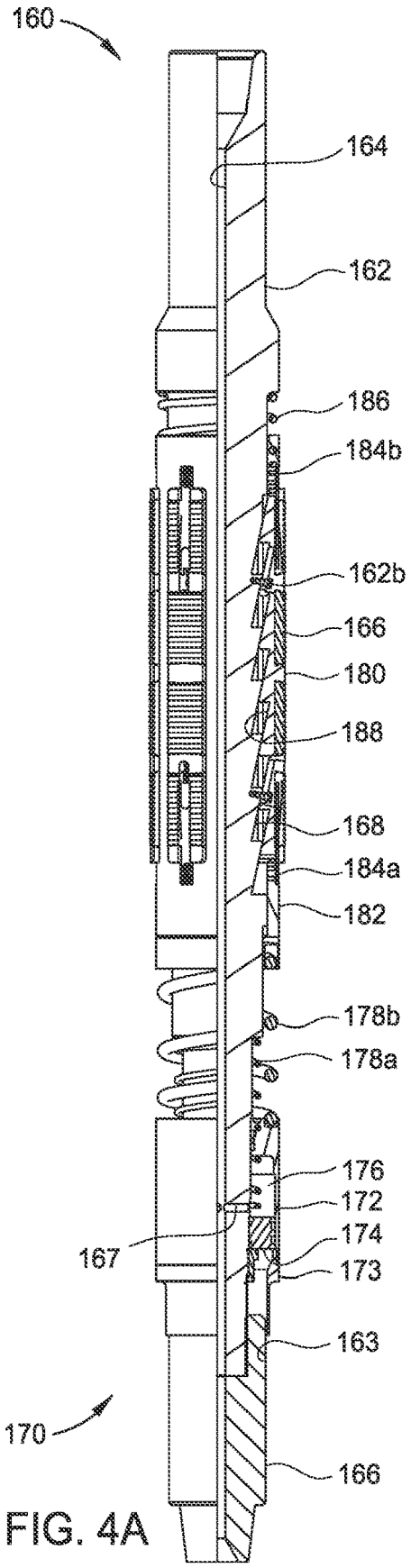
FIG. 4A illustrates a cross-sectional view of the anchor section of the pulling tool in the set position, in accordance with the first embodiment of the present disclosure.
Figure 4B:
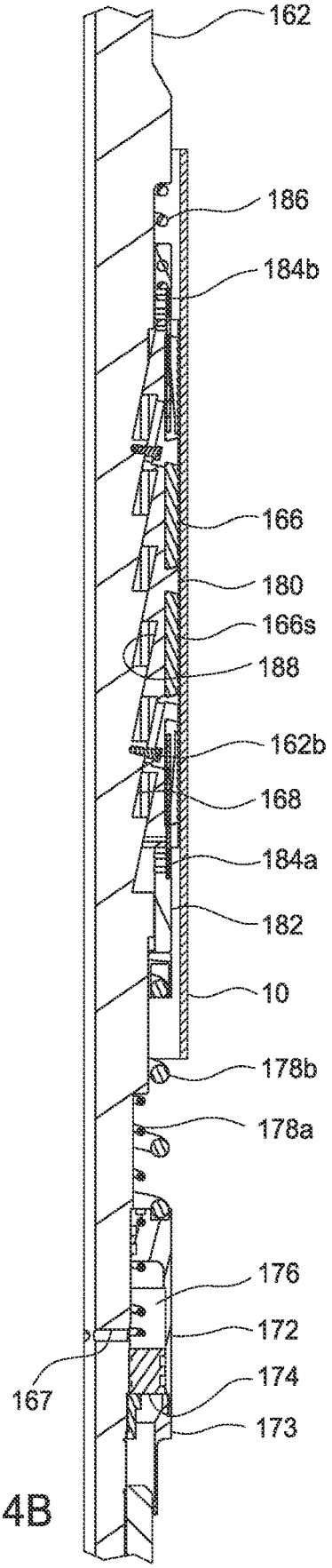
FIG. 4B illustrates a detailed cross-sectional view of the carrier and the anchor piston of the anchor section in the set position, in accordance with the first embodiment of the present disclosure.

As best shown in the detailed views of FIGS. 3B and 4B, the anchor piston 170 has at least one first biasing element 178*a* biasing the anchor piston 170 to the first position. The first biasing element 178*a* can be a spring having one portion engaged against a shoulder of the anchor mandrel 162 and having an opposing portion engaged against the anchor piston 170.

In the present embodiment, the anchor piston 170 also has at least one second biasing element 178*b* disposed between the anchor piston 170 and the carrier 180. The second biasing element 178*b* is a push spring having one portion engaged against the anchor piston 170 and having an opposing portion engaged against the carrier 180 via the cage 182.

As also best shown in the detailed views, the anchor carrier 180 may include at least one third biasing element 184*a-b* biasing the carrier 180 to the retracted position. The third biasing elements 184*a-b* may be leaf springs affixed to the cage 182 and engaged against ends of the carrier 180. Finally, a return spring 186 may also be used at the uphole ends of the carrier 180 to urge the carrier 180 to return to the unset position. In some embodiments, the third biasing elements 184*a-b* bias the carrier 180 to the extended position.

The spring retainers 184*a-b* on each end of the carrier 180 are multi-functional. The spring retainers 184*a-b* during operations not only hold each carrier 180 in place, but also assist in the return of the carrier 180 to the reset positions. Additionally, the screws holding the spring retainers 184*a-b* on the cage 182 are removable along with the bolts 162*b*, which allows operators to easily replace carrier 180 and/or inserts 166 if worn or if a new carrier 180 and/or inserts 166 are needed to accommodate a change in casing diameters. Additionally, operators may replace and/or switch modular inserts 166 according to the desired operation to be performed, such as backing off casing and/or well abandonment. For example, a casing backoff operation may require inserts 166 capable of transmitting torque and pull load. Operators may select the appropriate modular inserts 166 based on the configuration of the wickers on the gripping surface 166*s*. For example, at least some of the wickers may be arranged horizontally on the gripping surface 166*s* in order to transmit torque during operation. This can be done on the rig floor if needed.

When internal pressure is applied, the anchor piston 170 moves up toward the cage 182 with the piston's force transferred to the cage 182 by the push spring 178*b*. Movement of the cage 182 forces the carriers 180 out and the inserts 166 against the casing 10 by riding the carrier ramps 188 against the mandrel's ramps 168 and wedging the carrier 180 against the mandrel 162. The inserts 166 move relative to the carrier 180 while engaging the inserts 166 with the stuck component, thereby anchoring the tool in the wellbore. The movement of the inserts 166 relative to the carrier 180 allows the inserts 166 to better follow contours of the internal surface of the stuck component. Additionally, movement of the insert 166 relative to the carrier 180 more evenly distributes the load applied by the inserts 166 against the casing 10. The movement of the anchor piston 170 is limited by a shoulder 165 on the mandrel 162. As can be seen, the push spring 178*b* allows for some play and adjustment between the components, which may be desirable during operations.

When pressure is released, the carrier 180 may remain in the extended position due to the downward weight and the pull of the puller 110 and other components. The upward pull of the mandrel 162, however, relieves the wedging between the ramped surfaces 168, 188 so the inserts 166 can dislodge from inside of the casing 10 and release the anchor 160 to the reset position. The return spring 178*a* on the mandrel 162 also presses back against the anchor piston 170 (in the absence or release of pressure) to help move the piston 170 back in the reset position, which also helps place the carrier 180 in the retracted (released) position. Finally, the other springs 184*a-b* and 186 can further assist with unsetting the carrier 180.

Figure 7A:
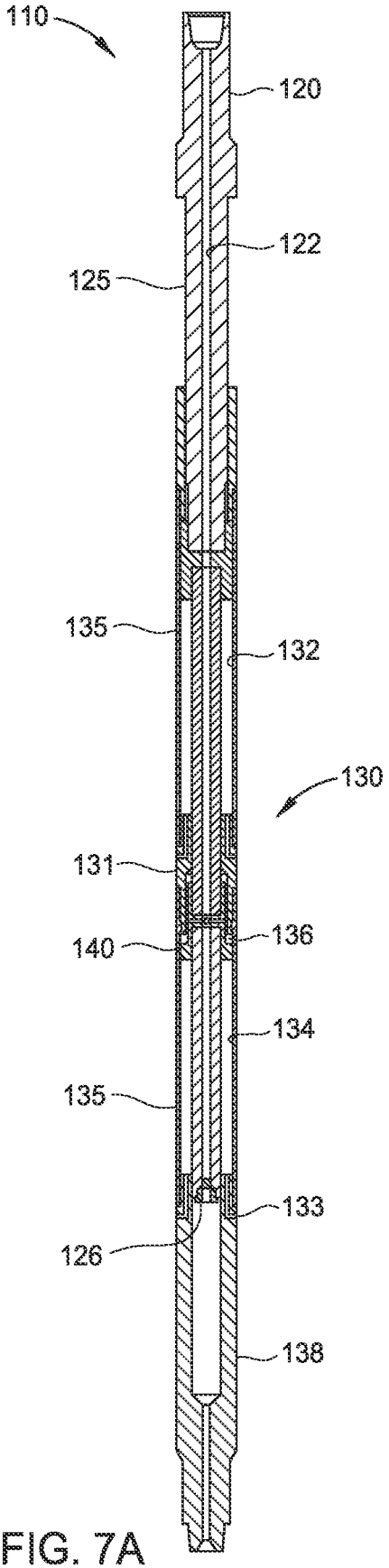
FIG. 7A illustrates an isolated cross-sectional view of a power section of the pulling tool in an unstroked position, according to the present disclosure.
Figure 7B:
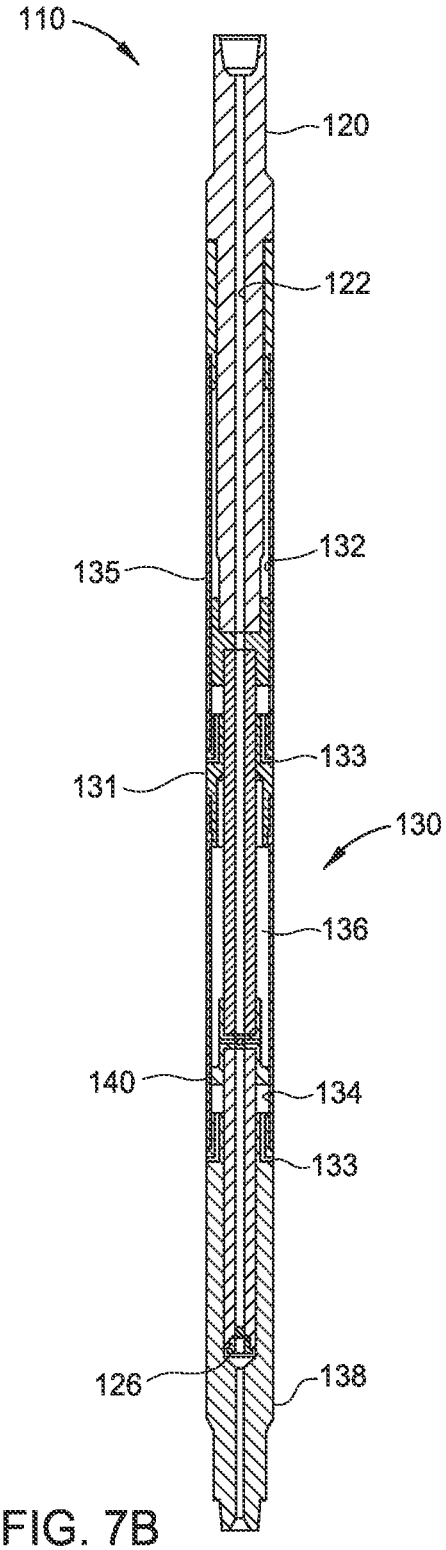
FIG. 7B illustrates an isolate cross-sectional view of the power section of the pulling tool in a stroked position, according to the present disclosure.

As shown in FIGS. 7A and 7B, the puller 110 has a puller mandrel 120 that couples at an uphole end to the anchor 160 and extends from the anchor mandrel 162. The puller mandrel 120 therefore forms part of the overall mandrel of the tool 100. At least one puller piston 130 is disposed on the puller mandrel 120 and at least one piston head 140 on the mandrel 120.

Although one puller piston 130 is shown, multiple pistons 130 can be stacked along the length of the puller 110 with an extended puller mandrel 120. In fact, the puller may have a number of puller pistons 130 to increase the stroke power of the tool 100. In this way, the puller 110 can be configured for a particular pull load by adding or removing the pistons 130. For example, up to five pistons 130 can be used with the pulling tool 100, but if the pull loads are lower for whatever reasons, the pulling tool 100 can be modified at the rig or at the shop to have the desired number of pistons 130.

The puller piston 130 is hydraulically movable relative to the puller mandrel 120 from an extended position to a pulled position during operations as discussed herein. The puller piston 130 includes a body 131 defining an upper chamber 132 and a lower chamber 134 with an intermediate chamber 136 disposed between them. To form these chambers 132, 134, and 136, the body 131 of the piston 130 is disposed on the mandrel 120 and includes external members or cylinders 135 that transmit all the pull loads and torque downhole. To transmit torque from the mandrel 120 to the piston, the puller's mandrel 120 can have a torque transmission, splines, or hex drive 125 that engages the piston 130. An end body 138 is disposed at the distal end of the tool (i.e., past the last piston 130 if multiple pistons are used) for coupling to other components of the pulling tool 100, such as the implement or fishing tool 50.

The puller mandrel 120 defines a fluid passageway or bore 122 communicating with the workstring 35 via the anchor 160. A valve 126 in the puller bore 122 can selectively communicate fluid conveyed through the puller mandrel 120 to the puller piston(s) 130 and the anchor 160. For example, the valve 126 can be a ball seat to engage a dropped ball deployed to the puller 110 during operations. Other types of valves, seats, or the like could be used.

In one example, a sleeve and port arrangement can be used for the valve 126 that is activated by a radio frequency identification (RFID) tag or the like, using techniques known in the art. When an appropriate RFID tag is deployed to the tool 100, for example, the valve 126 can close to selectively communicate fluid through the puller mandrel 120 to the puller piston 130. In other examples, a mechanical sleeve using j-slots and the like can be used to mechanically open and close circulation to the puller piston 130.

During operations when fluid pressure is pumped behind the closed valve 126, the hydraulic pressure actuates the puller piston(s) 130. In particular, the hydraulic pressure exits from the mandrel's bore 122 to the intermediate chamber 136 via crossports 142 at the piston head 140. Trapped pressure builds in the intermediate chamber 136 being sealed therein by seals against the exterior of the mandrel 120 and seals on the piston head 140. The intermediate chamber 136 expands as the upper and lower chambers 132 and 134 decrease in volume and vent through ports 133. As a result, the entire body 131 of the piston 130 as well as the end body 138 stroke up a length along the mandrel 120. For example, the stroke length can be 36 inches.

In an alternative embodiment, the anchor 160 may be coupled to and/or used with an alternative puller and/or alternative pulling tool, such as the pullers and/or the pulling tools disclosed in U.S. Patent Application Publication No. 2016/0076327, which is herein incorporated by reference in its entirety. In the alternative, the anchor 160 may be used with other wellbore tools and/or in other wellbore operations, such as backing off casing and/or well abandonment.

In one or more of the embodiments described herein, an anchor for use in a wellbore includes a mandrel, a carrier disposed on the mandrel and movable relative to the mandrel between an extended position and a retracted position, and an insert configured to engage an internal surface of a tubular, the insert movably disposed in the carrier as the carrier moves between the extended position and the retracted position.

In one or more of the embodiments described herein, the carrier includes a pocket configured to receive the insert.

In one or more of the embodiments described herein, the pocket is a dovetail groove.

In one or more of the embodiments described herein, the pocket includes a base and an opening.

In one or more of the embodiments described herein, a length of the base is greater than a length of the opening.

In one or more of the embodiments described herein, the anchor further includes a clearance between the pocket and the insert.

In one or more of the embodiments described herein, the insert includes a gripping surface and two tapered end surfaces.

In one or more of the embodiments described herein, the anchor further includes a fastener movably coupling the carrier and the mandrel, wherein the carrier includes an opening, and the fastener is at least partially disposed in the opening.

In one or more of the embodiments described herein, the anchor further including a biasing element biasing the carrier towards the retracted position.

In one or more of the embodiments described herein, wherein the insert includes a slot configured to receive the biasing element.

In one or more of the embodiments described herein, wherein the insert is longitudinally movably disposed in the carrier.

In one or more of the embodiments described herein, wherein the insert is movably disposed within the pocket.

In one or more of the embodiments described herein, a downhole casing pulling tool includes a mandrel extending through an anchor and a puller; the anchor including a carrier disposed on the mandrel and movable between an extended position and a retracted position and a plurality of inserts movably disposed in the carrier as the carrier moves between the extended position and the retracted position, the plurality of inserts configured to engage an internal surface of a tubular; and the puller including a puller piston disposed on the mandrel and movable between a first position and a second position.

In one or more of the embodiments described herein, wherein the carrier includes a plurality of pockets, each pocket is configured to receive one of the plurality of inserts.

In one or more of the embodiments described herein, the downhole casing pulling tool further including a clearance between each pocket and the one of the plurality of inserts.

In one or more of the embodiments described herein, each of the plurality of pockets includes a base and an opening.

In one or more of the embodiments described herein, a length of the base is greater than a length of the opening.

In one or more of the embodiments described herein, wherein each of the plurality of inserts includes a gripping surface and two tapered end surfaces.

In one or more of the embodiments described herein, wherein each of the plurality of inserts is longitudinally movably disposed in the carrier.

In one or more of the embodiments described herein, wherein each of the plurality of pockets includes at least one of a stepped side, a curved side, and an angled side.

In one or more of the embodiments described herein, wherein each of the plurality of inserts includes at least one side complementary to the at least one side of the respective pocket.

In one or more of the embodiments described herein, wherein each of the plurality of inserts is movably disposed in the carrier as the plurality of inserts engage the internal surface of the tubular.

In one or more of the embodiments described herein, wherein the plurality of inserts are arranged longitudinally in the carrier.

In one or more of the embodiments described herein, a fastener movably coupling the carrier and the mandrel.

In one or more of the embodiments described herein, wherein the carrier includes an opening, the fastener at least partially disposed in the opening.

In one or more of the embodiments described herein, a biasing element configured to bias the carrier towards the retracted position.

In one or more of the embodiments described herein, wherein at least one of the plurality of inserts includes a slot configured to receive the biasing element.

In one or more of the embodiments described herein, the carrier further including at least one tab formed between adjacent pockets, wherein the tab includes a slot configured to receive a biasing element.

In one or more of the embodiments described herein, the clearance is a range between six hundredths of an inch and five thousandths of an inch.

In one or more of the embodiments described herein, a method for anchoring a tool in a wellbore includes deploying the tool into the wellbore through a tubular to a first position, the tool including an anchor having a carrier and an insert disposed in the carrier; extending the carrier towards the tubular; and moving the insert relative to the carrier while engaging the inserts with the tubular, thereby anchoring the tool in the wellbore.

In one or more of the embodiments described herein, the method further comprising disengaging the insert with the tubular, moving the tool through the tubular to a second position, and after moving the tool to the second position, re-engaging the insert with the tubular.

In one or more of the embodiments described herein, wherein the tool further includes a fishing tool.

In one or more of the embodiments described herein, the method further including moving the insert relative to the carrier while extending the carrier towards the tubular.

In one or more of the embodiments described herein, the method further including engaging a stuck component in the wellbore with the fishing tool, dislodging the stuck component, and retrieving the stuck component and the tool.

It will be appreciated with the benefit of the present disclosure that features described above in accordance with any embodiment or aspect of the present disclosure can be utilized, either alone or in combination, with any other described feature, in any other embodiment or aspect of the present disclosure.

While the foregoing is directed to embodiments of the present disclosure, other and further embodiments of the disclosure may be devised without departing from the basic scope thereof, and the scope thereof is determined by the claims that follow.

The invention claimed is:

1. A downhole casing pulling tool, comprising:

a mandrel extending through an anchor and a puller;

the anchor comprising:

a carrier disposed on the mandrel and movable between an extended position and a retracted position;

a plurality of pockets formed in an outer surface of the carrier, each pocket formed by two opposing sides with a base and an opening therebetween, the sides located at opposite longitudinal ends of each pocket;

a plurality of inserts, each insert:

disposed on the base of a corresponding pocket of the plurality of pockets; and including opposing ends disposed between the sides of the pocket such that the insert is moveable longitudinally within the pocket between the opposing sides of the pocket; and the puller comprising:

a puller piston disposed on the mandrel and movable between a first position and a second position.

2. The downhole casing pulling tool of claim 1, wherein: a length of the base is greater than a length of the opening of each pocket.

3. The downhole casing pulling tool of claim 1, wherein at least one of the sides of each of the plurality of pockets includes at least one of a stepped side, a curved side, or an angled side.

4. The downhole casing pulling tool of claim 3, wherein at least one of the ends of each of the plurality of inserts is complementary to the at least one side of the corresponding pocket.

5. The downhole casing pulling tool of claim 1, wherein each of the plurality of inserts is movably disposed in the carrier as the plurality of inserts engage an internal surface of a tubular.

6. The downhole casing pulling tool of claim 1, wherein the plurality of inserts is arranged longitudinally in the carrier.

7. The downhole casing pulling tool of claim 1, further comprising a cage surrounding the carrier, the cage including an opening corresponding to the plurality of inserts, wherein in use, the cage urges the carrier and the plurality of inserts to move axially relative to the mandrel from a first axial position to a second axial position.

8. The downhole casing pulling tool of claim 1, wherein an outer surface of each insert of the plurality of inserts includes a gripping formation.

9. The downhole casing pulling tool of claim 1, wherein a clearance exists between the ends of each insert and the sides of each corresponding pocket.

* * * * *